US008424210B2

(12) United States Patent
Moore

(10) Patent No.: US 8,424,210 B2
(45) Date of Patent: Apr. 23, 2013

(54) MULTI-BLADE FAN RAZOR

(76) Inventor: Milton D. Moore, Pearland, TX (US)

( * ) Notice: Subject to any disclaimer, the term of this patent is extended or adjusted under 35 U.S.C. 154(b) by 705 days.

(21) Appl. No.: 12/342,685

(22) Filed: Dec. 23, 2008

(65) Prior Publication Data

US 2009/0178281 A1 Jul. 16, 2009

Related U.S. Application Data

(60) Provisional application No. 61/020,957, filed on Jan. 14, 2008.

(51) Int. Cl.
*B21B 21/22* (2011.01)
*B21B 21/44* (2011.01)

(52) U.S. Cl.
USPC ..... 30/41.5; 30/48; 30/50; 30/346.57; 30/538; 30/527

(58) Field of Classification Search ..... 30/34.1, 30/41–41.5, 48, 49, 50, 140, 527–528, 346.5, 30/346.51, 346.57, 346.59, 356, 538; D28/45
See application file for complete search history.

(56) References Cited

U.S. PATENT DOCUMENTS

| | | | | | |
|---|---|---|---|---|---|
| 228,829 | A * | 6/1880 | Moody | 30/50 |
| 1,387,465 | A * | 8/1921 | Browning | 30/48 |
| 1,506,533 | A * | 8/1924 | Klecka | 30/48 |
| 1,589,826 | A * | 6/1926 | Strand | 30/48 |
| 1,892,836 | A * | 1/1933 | Harvey | 30/41 |
| 2,517,028 | A * | 8/1950 | Ridner, Sr. | 30/50 |
| 4,208,791 | A * | 6/1980 | Van Cleve | 30/49 |
| 4,534,110 | A * | 8/1985 | Glass | 30/346.57 |
| 4,638,560 | A * | 1/1987 | Higashi | 30/47 |
| 4,720,917 | A * | 1/1988 | Solow | 30/49 |
| 4,791,724 | A * | 12/1988 | Dumas | 30/526 |
| 5,778,535 | A * | 7/1998 | Ledesma | 30/50 |
| 5,911,480 | A * | 6/1999 | Morgan | 30/41 |
| 6,216,345 | B1 * | 4/2001 | Andrews | 30/50 |
| 7,178,241 | B1 * | 2/2007 | Cummings et al. | 30/41 |
| 2006/0236546 | A1 * | 10/2006 | Johnson et al. | 30/50 |
| 2007/0084058 | A1 * | 4/2007 | Szczepanowski et al. | 30/34.05 |

* cited by examiner

*Primary Examiner* — Laura M. Lee
(74) *Attorney, Agent, or Firm* — Conley Rose, P.C.

(57) ABSTRACT

A shaving apparatus and method of shaving incorporate a novel, segmented, shaving head comprising multiple razors. In addition, embodiments of the shaving apparatus include an applicator head which provides lubrication and/or hydration while shaving.

31 Claims, 2 Drawing Sheets

MULTI-BLADE FAN RAZOR

CROSS-REFERENCE TO RELATED APPLICATIONS

This application claims the benefit under 35 U.S.C. §119 (e) of U.S. Provisional Application No. 61/020,957, filed Jan. 14, 2008, the disclosure of which is hereby incorporated herein by reference.

STATEMENT REGARDING FEDERALLY SPONSORED RESEARCH OR DEVELOPMENT

None.

BACKGROUND

1. Field of the Invention

This invention relates generally to the field of skin treatment. More specifically, the invention relates to a method of shaving the skin.

2. Background of the Invention

The act of shaving for the removal of facial hair is a daily personal hygiene process undertaken by men daily. Shaving prevents a build up of oils, contaminants and foreign material that maybe trapped close to the skin by facial hair. Additionally, the removal of facial hair by shaving is done for aesthetic purposes. Women shave legs and underarms as an aesthetic approach to personal hygiene.

The act of shaving with a manual razor, or bladed razor involves sliding a straight blade along the skin to slice the hair. This act is complicated by the fact that metallic blades are necessarily kept rigid and straight, and do not conform to the curves of the human anatomy. Additionally, the razor head of commercially available products have a limited or negligible range of motion to conform to the skin, requiring reorienting the entire razor to so the blades optimally cut hair. Alternatively, multiple passes with the blade are required to sufficiently remove the hair. This process may result in localized irritation of the skin, razor bumps, or razor burn. Razor bumps (i.e., pseudofolluculitis barbae) are typically presented as small inflamed pustules on the skin. In addition, razor burn is irritation and inflammation of the skin from microtears and cuts caused by a razor during shaving. The blades may cut or nick the skin, opening small wounds to potential infection. Proper shaving techniques may partially alleviate these issues; however the characteristics of the implement increase the likelihood of these side effects.

Consequently, there is a need for a multi-bladed razor that conforms to the contours of the skin and encourages proper shaving techniques.

BRIEF SUMMARY

A shaving apparatus and method of shaving are disclosed herein. Embodiments of the shaving apparatus incorporate a novel, segmented, shaving head comprising multiple razors. In addition, embodiments of the shaving apparatus include an applicator head which provides lubrication and/or hydration while shaving. Some other advantages of the disclosed shaving devices include increased cutting surface area, heated lubrication, and contoured shaving. Further aspects and features of the shaving apparatus are described in more detail below.

The foregoing has outlined rather broadly the features and technical advantages of the invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

NOTATION AND NOMENCLATURE

Figure 1:
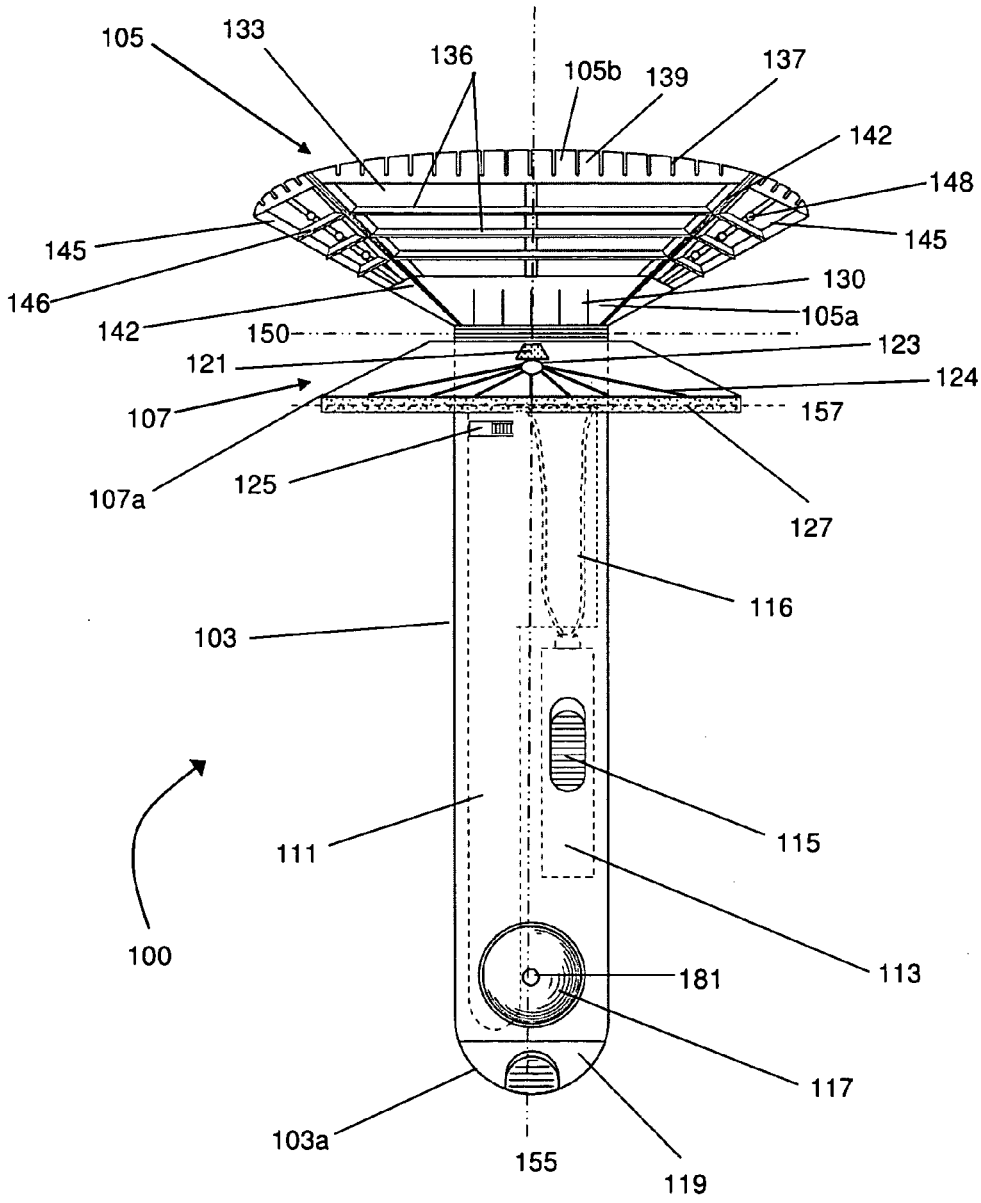
FIG. 1 illustrates an embodiment of a shaving apparatus.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct electrical connection. Thus, if a first device couples to a second device, that connection may be through a direct connection, or through an indirect connection via other devices and connections.

DETAILED DESCRIPTION OF THE PREFERRED EMBODIMENTS

Certain terms are used throughout the following descriptions and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

FIG. 1 illustrates an embodiment of a multi-blade shaving razor 100. The razor 100 generally includes a hollow body 103 is either removably or permanently coupled to a shaving head 105, and an applicator head 107. The hollow body 103 has a first end 103*a* and a second end 103*b*. Disposed at the second end 103*b* are the shaving head 105 and the applicator head 107. Shaving head 105 is removably and movably coupled to hollow body 103. The shaving head 107 supports a plurality of razor blades 36 for shaving hair close to the skin. Further, the applicator head 107 is similarly configured, and is also removably connected to the hollow body 103. One purpose of the applicator head 107 may be to provide and spread lubrication and/or hydration to the skin while shaving.

In general, hollow body 103 functions as the handle or handheld portion of the razor 100. In an embodiment, hollow body 103 may be contoured to comfortably fit a user's hand. For example, hollow body 103 may have a grip and curved aspect. The body 103 includes an upper surface 157 and a lower surface 159. The hollow body 103 is generally elongate, with a plurality of internal compartments that can be sealed and unsealed from the outside. In some embodiments, hollow body 103 may be planar in geometry and have a length to width ratio of 2:1. That is, the hollow body 103 may be wider than a typical shaving device for further comfort. Furthermore, hollow body 103 may contain a fluid compartment 111 for the storage of fluids such as lubricants, shaving crème, shaving gels, moisturizers, topical skin treatments, lotions, crèmes, creams, salves, emollients, talcs, lubricants, moisturizers, foams, soaps, detergents, gels or combinations thereof. In a preferred embodiment, the skin treatment is a gel.

The fluid compartment 111 is in fluid communication with the applicator head 107. Disposed on the surface of hollow body 103 is a pump or pump means 117 to move the fluid from the fluid compartment 111 to the applicator head 107. Pump means 117 may comprise a one way air valve/opening 181 which may be opened or closed to allow pressurize compartment 111, thereby allowing fluid within compartment 111 to be pumped out. In addition, opening 181 may be open or shut so as to prevent leakage of fluid from compartment. Fluid compartment 111 may hold any suitable amount of fluid. Specifically, fluid compartment may be capable of holding about 10 to about 20 mL of fluid. The fluid within compartment 111 may be pumped or ejected by any means known to one skilled in the art such as an air bulb or a one way valve. Without being limited by theory, the pump 117 inflates a pneumatic bladder with air, such that the bladder inflates and squeezes the topical skin treatment out of the fluid compartment 111 and into the applicator head 107. In the illustrated embodiment, the pump 117 may be disposed on the lower surface 159 of the body 103. Alternatively, the pump 117 may be disposed on the upper face 157 of the hollow body 103.

Hollow body 103 may also include a power source such as without limitation, a battery 113. Battery 113 may be used primarily to power heating element 116. Alternatively, power source may come from AC or DC current from a wall outlet. Generally, heating element 116 is used to warm the fluid before ejection on to the skin. Some fluid compositions may be more effective at a raised temperature. Heating element 116 may comprise an insulated linear device capable of transferring heat such as, but not limited to a wire filament, a braided wire, or a filament heater. The battery 113 may also be coupled to the heating element 116 reversibly so that the electrical power supply in the battery by a controller 115. The controller 115 allowing the user to define the amount of heat used in the razor 100. In the illustrated embodiment, the control 115 may be disposed on the lower surface 159 of the body 103. Alternatively, the control 115 may be disposed on the upper face 157 of the body 103.

Additionally, the body 103 includes a means to access the internal compartments such as a cap or end piece 119. The cap 119 is a replaceable or removable member (e.g. cap) disposed at the free end 103*a* of the body. In embodiments, the cap 119 is sealed from the outside environment in a water tight manner. Generally speaking, razors are exposed to water and other liquids during use. Penetration of the body compartments by one of these liquids would have negative effects on the heating element and fluid compartment operations.

Figure 2:
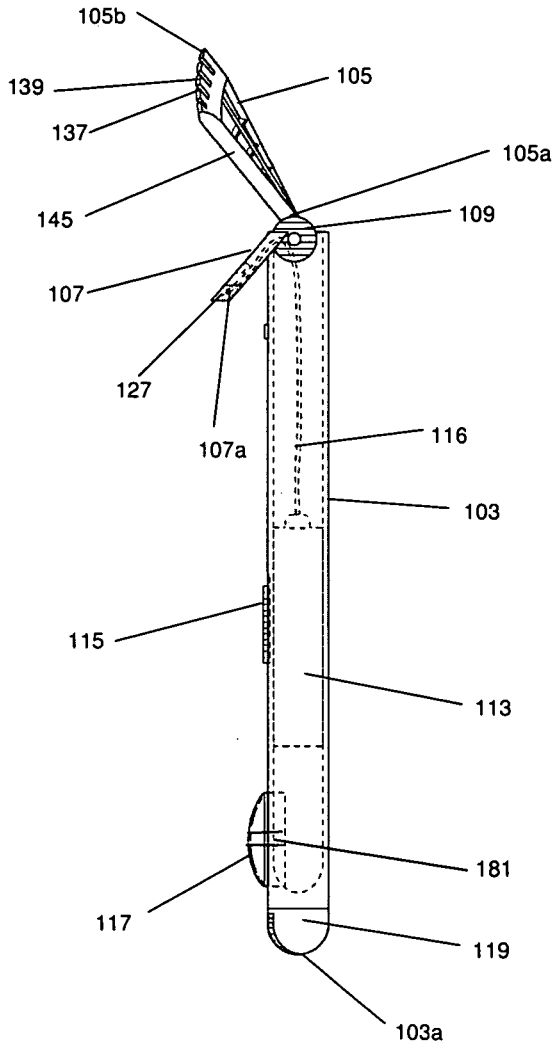
FIG. 2 illustrates a side view of an embodiment of a shaving apparatus.

At the second end of the hollow body 103, the shaving head 105 and the applicator head may be coupled to the hollow body 103 by a pivoting member 109. The pivoting member 109 may pivot about an axis 150, which is perpendicular to the longitudinal axis 155 of the hollow body 103. The pivoting member allows the applicator head 107 and the razor head 105 to pivot in relation to the handheld body 103 during use about axis 50. Disposed on the pivoting member 109 is a means for attachment of the applicator head at the second end 107*b*. In embodiments, the applicator head 107 may be removable from the pivoting member 109 for replacement, repair or the attachment of alternate heads. The applicator head 107 is disposed on the pivoting member 109 more proximally to the body 103 than the shaving head. Additionally, the applicator head 107 extends in a downward orientation away from the lower surface 159 of the body 103. When viewed in profile as in FIG. 2, applicator head 105 may extends further than shaving head 105 such that applicator head 105 contacts the skin first and forces the user to press down on or angle the shaving head 105 to make contact with the skin.

Applicator head 107 is in fluid connection with the fluid compartment 111. The fluid connection may be through vessels or tubes that allow the passage of the topical skin treatment. Openings, or fluid exits 123 in the applicator head 107 allow the skin treatment to be secreted from the internal environment of the body 103, to the external surface of the applicator head 107. Applicator head 107 may comprise a single opening (as shown in FIG. 1) or a plurality of openings 123. One or more troughs or grooves 124 may lead from opening 123 to applicator 127 so as to allow gel and/or lubricant to flow from opening 123 to applicator 127. An advantage of the disclosed shaving apparatus 100 is the location of applicator head 107 such that lubrication may be provided through openings 123 to the skin before razor blades 136 contact the skin. Openings, or fluid exits 123 may have a cap or other closing means 121 to prevent fluid from leaking out. Or the cap or closing means may be used in case the user desires to shave in a conventional manner (i.e. applying shaving gel/cream to face prior to shaving). For example, lid or slidable member 121 may be disposed on applicator head 107 to close opening 123 to prevent inadvertent leakage of lubricant and/or gel during travel. Alternatively, applicator head 107 may be closed or not have openings. That is, applicator head 107 may solely comprise applicator 107*a* for lubrication. Thus, in such an embodiment, the razor 100 may also be used in conventional manner where shaving gels or creams may be applied by hand to the face first before shaving.

The openings 123 may be controllable with a sliding switch 125 to open or close openings 123. In one embodiment, the switch 125 may be disposed on the applicator head 107. In an alternative embodiment, the switch 125 may be disposed elsewhere on the body 103 such as without limitation, on the lower face 159 of the body. Without being limited by theory, the switch 125 acts in a graduated fashion, so as to open the fluid exits 123 differentially as a means to control the rate of secretion of the topical skin treatment.

Free end of the applicator head 107*a* may be means to apply the skin treatment to the skin. The free end 107*a* may comprise an applicator 127. Applicator 127 preferably comprises a spongy, foam-like bar. The applicator 127 may be constructed out of a firm, deformable elastic material so that it follows the contours of the skin closely. Alternatively, applicator 127 itself may be made of a lubricating material, which dissolves or erodes as it is applied to the face. Exemplary materials for the applicator 127 include, but are not limited to urethane, polyethylene, polypropylene, rubber, or combinations thereof. The applicator 127 may be constructed in any shape, so that it slides across the skin smoothly. In further embodiments, the applicator 127 may be cylindrical, and capable of rotating about an axis 157.

The applicator head 107 is also constructed such that the heating element 116 passes through the head to the applicator 127. Heating element 116 may comprise for example, a heating wire. The heating element 116 warms the applicator 127 and the secreted topical skin treatment. The warmth coupled with the fluid increases the flexibility of the skin, the swelling of hair to be shaved and the lubricating effects of liquids on the skin. As the razor 100 is moved across the skin, the applicator 107 contacts the skin to supply the topical skin treatment ahead of the shaving head 105, acting as a means to pretreat the skin. Without being limited by theory, these positive characteristics increase the comfort of the shave and decrease the likelihood of razor burn, or nicks.

The shaving head 105 is connected to the pivoting member at the second end 105*b*. In embodiments the shaving head 105 is detachable and replaceable on the pivoting member 109. Disposed on the pivoting member 109 is a means to removably connect and retain the shaving head 105. The second end of the shaving head 105*b* includes a means to connect to the pivoting member 109. Examples of such means includes without limitation, snap fit connections, latch connections, and the like. This allows the shaving head 105 to pivot in relation to the body 103, such that the shaving head 105 can follow the contours of the skin during use. The shaving head 105 provides support for the razor blades 136.

Shaving head 105 may comprise any suitable shape. In an embodiment, the shaving head 105 may comprise a fan shape as shown in FIG. 1. Alternatively, shaving head 105 may comprise a semi-circular head, a rectangular head, a triangular head, or other suitable shapes. The shaving head 105 is made up of at least three portions (e.g. lateral portions and a middle portion) for the support of shaving razor blades 136. The three portions of shaving head 105 provide flexibility and allow the shaving head 105 to conform to the irregular structure of a user's face. The razor blades 136 can be constructed of any suitable material. Examples of suitable materials for the razor blades are titanium, stainless steel, steel alloys, etc. Middle shaving portion 133 na lateral portions 145 extend from the pivoting member 109 away from the body 103. Middle shaving portion 133 may have a trapezoidal configuration such the width of proximal end 105*a* of middle shaving portion 133 is less than the width of the distal end 105*b* of middle shaving portion 133 as shown in FIG. 1. Both distal end and proximal end of middle shaving portion 105 has troughs or grooves 130, 137 to direct the topical skin treatment away from the body 103 and applicator head 107, towards the shaving razor blades 136. The grooves 130, 137 may also allow more lubricant to remain on the face after shaving for better lubrication and hydration of the skin. Shaving blades 136 may be angled at any suitable angle to provide for optimal shaving.

Disposed at both lateral edges or sides of the central or middle shaving portion 133 are the lateral shaving portions 145. Lateral shaving portions 145 are movably connected to the middle shaving portion 133 such that lateral portion 145 are operable to move with the contours of a user's face during shaving. In an embodiment, lateral shaving portions 145 may be connected to middle shaving portion 105 by hinge members 142. Hinged members 142 may keep the lateral shaving portions 145 in close contact with curved portions of the face or body. Hinged members 142 may comprise a piece of elastically deformable plastic which returns the lateral shaving portions 142 to their original conformation. In this embodiment, middle shaving portion 105 is fixed relative to the head 105, and lateral shaving portions 142 are pivotally coupled to the ends of middle shaving portion 105. Alternatively, hinge members 142 may comprise a door-hinge type member. In one embodiment, lateral shaving portions 145 may vibrate or move in an up and down motion such that blades on lateral shaving portions 145 tap the skin. The vibration motion may provide for a closer shave.

Disposed on the shaving head 105 are a plurality of razor blades 136 for shaving. The blades 136 are separated by a distance of about 0.5 mm to about 1.5 mm, preferably between about 0.75 mm to about 1.0 mm, in the exemplary embodiment the shaving blades are separated at a distance of about 0.75 mm to about 1.25 mm. The razor blades 146 mounted to the lateral shaving portions 145, include a pivotable means 148 to align the blades 146 with the direction of the shaving stroke. That is, razor blades 146 may be angled at any suitable angle to provide optimal shaving. Lateral razor blades 146 mounted on lateral shaving portions 145 increase the area shaved by about 15% to about 35%.

Additionally, it is envisioned that at the distal end 105*b* of the shaving head 105 is a plastic guard 139. In embodiments the plastic guard 139 has grooves 137, or ripples at the free end 105*a* of the shaving head 105. The plastic guard 139 is constructed out of flexible plastic, rubber, or similar material. The grooves 137 function to allow the topical skin treatment to remain on the skin. Additionally, the grooves may act as a means to massage the skin after the passage of the razor blades 136. In certain instances plastic guard 139 may include additional lubricants. Additional lubricants may be impregnated within the plastic, or alternatively disposed on the surface as a strip.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, the scope of protection is not limited by the description set out above, but is only limited by the claims which follow, that scope including all equivalents of the subject matter of the claims.

The discussion of a reference in the Description of the Related Art is not an admission that it is prior art to the present invention, especially any reference that may have a publication date after the priority date of this application. The disclosures of all patents, patent applications, and publications cited herein are hereby incorporated herein by reference in their entirety, to the extent that they provide exemplary, procedural, or other details supplementary to those set forth herein.

What is claimed is:

1. A shaving apparatus comprising:

a hollow body;

an applicator head, removably coupled to said hollow body, a shaving head, removably coupled to said hollow body, wherein said shaving head comprises a middle shaving portion having a trapezoidal shape along a longitudinal axis extending from a proximal end to a distal end, and at least two lateral shaving portions flexibly coupled to each side of said middle shaving portion, wherein each shaving portion is configured to shave hair, and where the at least two lateral shaving portions and said middle shaving portion each comprise at least three blades.

2. The apparatus of claim 1 wherein said shaving head is fan shaped.

3. The apparatus of claim 1 wherein each lateral shaving portion is coupled to said middle shaving portion with a hinged member.

4. The apparatus of claim 1 wherein at least one of said shaving head and said applicator head are disposable.

5. The apparatus of claim 1, wherein the body includes at least one compartment for the storage of topical skin treatments.

6. The apparatus of claim 1, wherein the hollow body includes at least one heating element.

7. The apparatus of claim 6, further comprising a power source coupled to said heating element.

8. The apparatus of claim 7, wherein said power source is a battery.

9. The apparatus of claim 8, wherein said hollow body includes a compartment cap for removably retaining a battery.

10. The apparatus of claim 6, wherein said hollow body comprises a control the heating element.

11. The apparatus of claim 1, wherein said applicator head comprises one or more openings in fluid communication with said hollow body.

12. The apparatus of claim 1, wherein said hollow body comprises a means to transfer a topical skin treatment to the applicator head.

13. The apparatus of claim 1, wherein said hollow body comprises a means to transfer heat to the applicator head.

14. The apparatus of claim 1, wherein said shaving head comprises at least nine blades.

15. The apparatus of claim 1, wherein the applicator head comprises means to apply skin treatment to the skin.

16. The apparatus of claim 1, wherein a flexible guard is connected to the shaving head.

17. The apparatus of claim 16, wherein the flexible guard contacts the skin in use.

18. The apparatus of claim 16, wherein the flexible guard includes grooves on the skin contacting surface.

19. The apparatus of claim 1, wherein the shaving head is pivotably connected to the body.

20. The apparatus of claim 1, wherein the lateral shaving portions are coupled to the shaving head with elastically deformable material.

21. The apparatus of claim 20, wherein the lateral shaving portions pivot to follow the contours of the skin.

22. The apparatus of claim 1, wherein said applicator head is disposed proximal to said shaving head.

23. The apparatus of claim 1, wherein said applicator head and/or shaving head are removably coupled to said hollow body via a connection means chosen from the group comprising a snap-fit connection, a latch connection, or other removable connection means.

24. An apparatus for shaving, which comprises:

a hollow body, the body including a plurality of compartments for topical skin treatments;

a topical skin treatment applicator head connected to the body;

a means to transfer topical skin treatments to the skin treatment applicator head;

a shaving razor head removably connected to the body in a pivotable manner, the shaving razor head comprising a middle shaving blade support and pivotable shaving blade supports coupled to each end of the middle shaving blade support; and the shaving razor head including a plurality of shaving blades mounted perpendicular to the body on the middle shaving blade support and a plurality of skin contour following shaving blades connected to each of the pivotable shaving blade supports.

25. The apparatus of claim 24, wherein topical skin treatments comprise at least one chosen from the group consisting of lotions, crèmes, creams, salves, emollients, talcs, lubricants, moisturizers, foams, soaps, detergents, gels and heat.

26. The apparatus of claim 24, wherein at least one topical skin treatment is heat.

27. The apparatus of claim 24, wherein a control is disposed on the body for controlling the skin treatment.

28. The apparatus of claim 24, wherein the skin treatment applicator is comprised of an elastically deformable material.

29. The apparatus of claim 24, wherein the shaving razor head is fan shaped.

30. The apparatus of claim 24, wherein the pivotable shaving blade supports are connected to the middle shaving blade support elastically.

31. The apparatus of claim 24, wherein the skin contour following blades pivot in response to the contours of the skin.

* * * * *